United States Patent [19]

Doerr et al.

[11] Patent Number: 4,773,520

[45] Date of Patent: Sep. 27, 1988

[54] STEERING APPARATUS FOR A TRAMMING CONVEYOR

[75] Inventors: Richard E. Doerr; John B. Riester, both of Morgantown, W. Va.

[73] Assignee: Consolidation Coal Company, Pittsburgh, Pa.

[21] Appl. No.: 333

[22] Filed: Jan. 5, 1987

[51] Int. Cl.[4] ..... B65G 41/00; B65G 43/00

[52] U.S. Cl. ..... 198/301; 198/861.2

[58] Field of Search ..... 198/301, 507, 588 X, 198/589, 594, 861.2 X

[56] References Cited

U.S. PATENT DOCUMENTS

| | | | |
|---|---|---|---|
| 3,422,949 | 1/1969 | Bankauf et al. | 198/301 |
| 3,625,339 | 12/1971 | Smith | 198/301 |
| 3,897,640 | 8/1975 | Swisher, Jr. et al. | 198/301 X |
| 4,476,975 | 10/1984 | Densmore | 198/861.2 |

FOREIGN PATENT DOCUMENTS

| | | | |
|---|---|---|---|
| 1373170 | 11/1974 | United Kingdom | 198/861.2 |

*Primary Examiner*—Robert J. Spar
*Assistant Examiner*—Jennifer Doyle
*Attorney, Agent, or Firm*—Alan N. McCartney; Cortlan R. Schupbach

[57] ABSTRACT

This invention describes a steering apparatus for a tramming conveyor having at least one end articulated about a vertical axis so that said articulated end can deviate angularly in either direction about the longitudinal axis of the conveyor. The steering apparatus basically comprises a control apparatus which is coupled to an external apparatus in a manner to communicate a deviation of the articulated end of the tramming conveyor from alignment with the external apparatus. The control apparatus generates an output responsive to the steering apparatus which will result in a deviation of the articulated end either to the right or left of the external apparatus, such steering apparatus will continue the deviation of the articulated end of the tramming conveyor until the tramming conveyor is again realigned with the external apparatus.

5 Claims, 3 Drawing Sheets

STEERING APPARATUS FOR A TRAMMING CONVEYOR

RELATED APPLICATIONS

This Application is related to a co-pending application Ser. No. 935,290 filed Dec. 5, 1986, which is a continuation in part of application Ser. No. 822,100, filed Jan. 24, 1986, by Richard E. Doerr, et al. and entitled "Mine Haulage Method and Apparatus". Such invention is assigned to the same assignee as this invention.

BRIEF DESCRIPTION OF THE PRIOR ART

In the above referenced co-pending application a mine Haulage system is described which uses a roof supported conveyor in combination with a tramming conveyor to transport material from a continuous mining machine to a final conveyor which will move the material out of the mine. In one step of the aforementioned method, the tramming conveyor and the roof supported conveyor must be moved backward along the mine Haulage way in order to accommodate the next step in the mining process. In order to move the tramming conveyor rearwardly, the discharge end must be steered so that it can follow the mine Haulage way. This invention solves the problem of moving the conveyor in a direction to carry out the next mining procedure.

BRIEF DESCRIPTION OF THE INVENTION

This invention basically describes a tramming conveyor in combination with a second conveyor which may be either roof supported or floor supported and is adapted to follow the tramming conveyor either forwardly along the mine Haulage way or rearwardly along the mine Haulage way depending upon the particular stage in the mining procedure. In order to follow the conveyor during a rearward movement of both the tramming conveyor and the second conveyor, a steering apparatus is provided which continuously maintains alignment of the tramming conveyor's articulated end with respect to the second conveyor. Such steering apparatus, in the preferred embodiment of this invention, is coupled between the tramming conveyor and one of the roof mounted rails supporting the second conveyor. The arm is pivotally attached to a vertically mounted shaft which in turns actuates a switch means so that rotation of the shaft about its vertical axis will cause the arm to move out of a neutral position to either a first or second position. The first or second position will cause a first or second output to a hydraulically actuated piston arrangement moving the piston arrangement in a manner to rotate the articulated end of the conveyor arcuately away from the longitudinal axis of the conveyor in a manner so that the articulated end of the conveyor will steer the conveyor in a direction to realign the conveyor with the desired direction along the mine Haulage way.

DETAILED DESCRIPTION OF THE INVENTION

Figure 1:
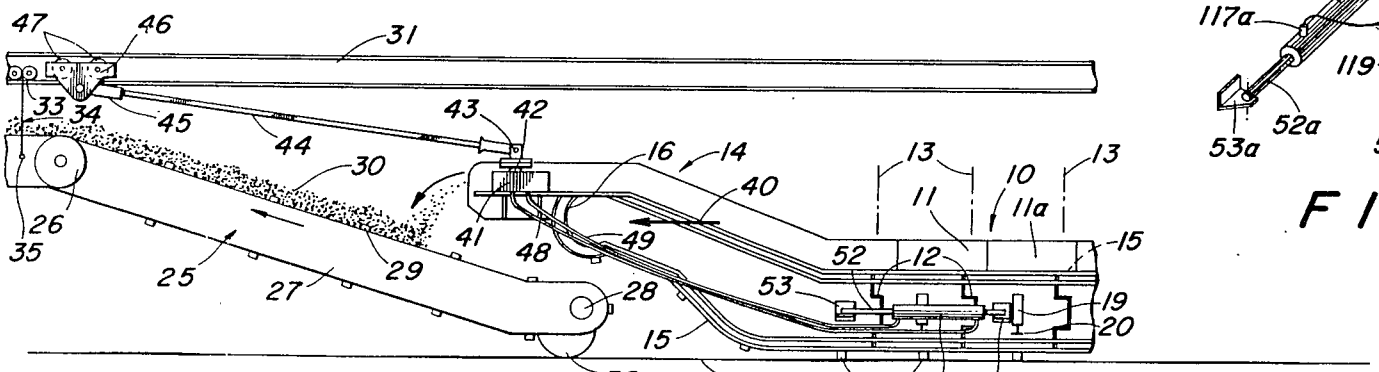
FIG. 1 is a side view of the tramming conveyor and second conveyor showing the installation of the control arm.

Referring to all of the drawings but in particular to FIG. 1, a tramming conveyor generally referred to by arrow 10 is comprised of a plurality of sections 11, 11*a*, etc. Each section 11, 11*a*, etc. is attached to the succeeding and preceding section by means of pivots 12. Each pivot 12 has a vertical axis 13. This embodiment of the tramming conveyor 10 has a material input end (not shown) and an articulated discharge end generally referred to by arrow 14. Conveyor 10 includes a belt or chain drive 15 which travels across the top of conveyor 10, around an arcuately formed discharge end 16 and along the bottom of the conveyor to the material input end where is returns to the top of the conveyor. Other embodiments of tramming conveyors for which this steering system will work can use different drive systems for tramming and for conveying, i.e. a belt conveyor mounted on a crawler chain drive for tramming. Conveyor 10 may contain one or more motors (not shown) for moving belt or chain 15. In the tramming configuration, belt or chain 15 is in contact with surface of a mining floor 17. Flights 18 which are in contact with floor 17 will move conveyor 10 in a direction opposite to the movement of the upper portion of belt 15. When in the conveying mode, jacks 19 will have an extension 20 which will lower and contact mine floor 17. Further extension will lift conveyor 10 off of the ground until flights 18 are free from contact with surface 17 of the mine floor. These jacks 19 and extensions 20 are not required in other embodiments where dual drives for tramming conveying are used.

A second conveyor, generally referred to by arrow 25, has a pivot 26 at its upper end with a downwardly extending end 27 with a terminus 28 generally mounted below articulated discharge end 14 of tramming conveyor 10. Second conveyor 25, likewise, contains a belt or chain 29 for moving material 30 up the conveyor for eventual disposal outside the mine.

In the particular second conveyor illustrated, conveyor 25 is supported by an overhead rail system which may be a monorail or a duorail or other arrangement. In the embodiment illustrated, a duorail system is illustrated comprising a rail 31 and a second rail 32 (see FIG. 3). A rolling support system 33 is attached via a cable rod or chain 34 or any other usual means to a location 35 on second conveyor 25. Additional supports 33, 34 and attachments 35 are provided along the full extent of conveyor 25 as necessary for supporting the conveyor away from mine floor 17. The pivoting end 27 of conveyor 25 may be supported by wheels or skids 36 on mine floor 17 or by hangers (not shown) to conveyor 10 or to the rail system overhead by means such as rolling supports 33, hangers 34 and attachment pivots 35.

Figure 2:
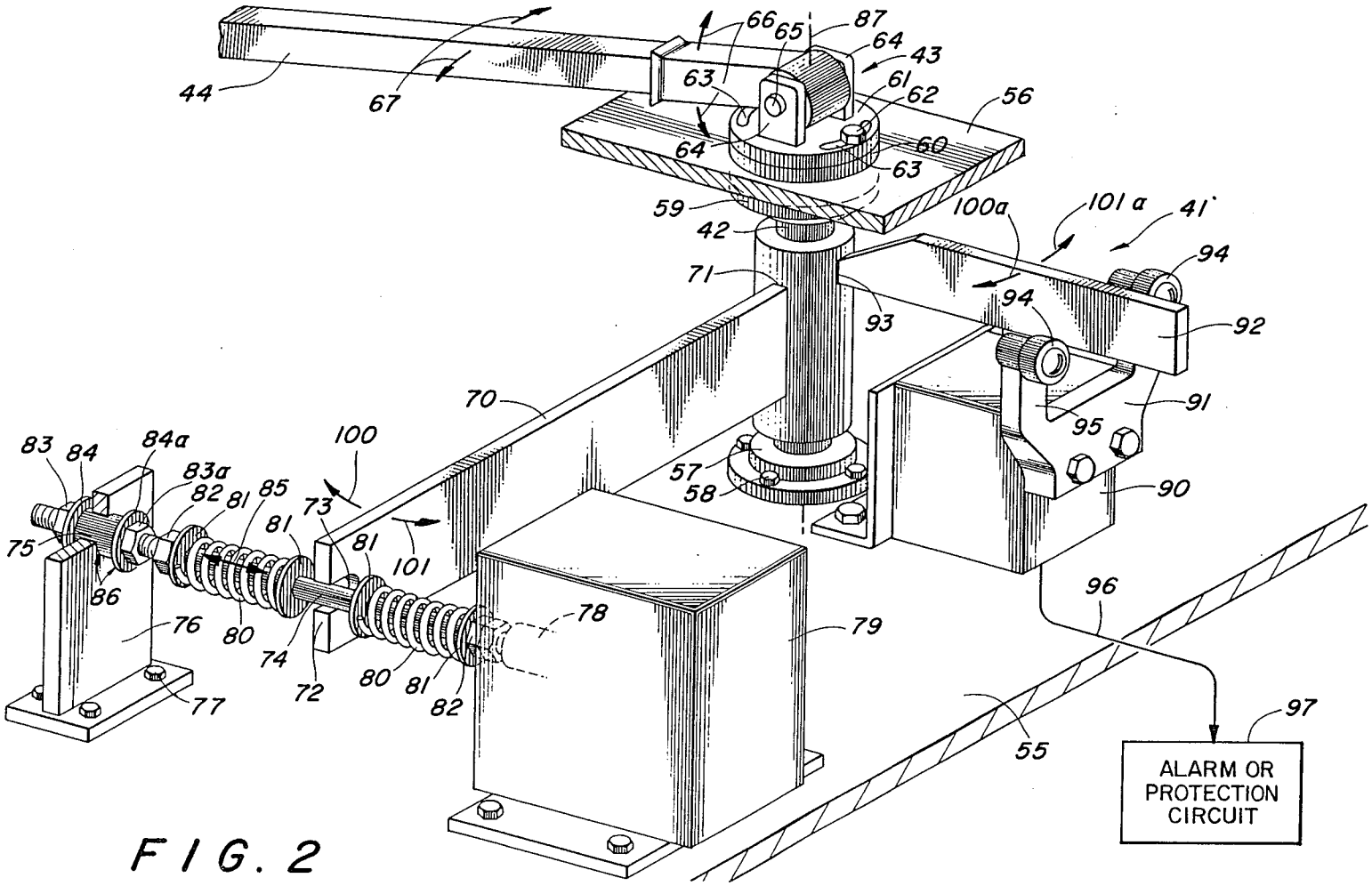
FIG. 2 is a detailed drawing of the apparatus used for controlling the position of the conveyor.

In order to provide some measure of control of tramming conveyor 10 during the retreat process, wherein tramming conveyor 10 is moving in the direction of arrow 40, a tramming control system 41 is provided. Tramming control system 41 has an input shaft 42 coupled to a pivotal connection 43 which in turn is coupled to following rod 44 which has its end 45 coupled to a roller attachment 46 which in turn is supported by rollers 47 on rail 31. The particular details of the tramming control system are specifically detailed in FIG. 2 and will be discussed when FIG. 2 is described. Hydraulic hoses 48 and 49 are coupled from tramming control system 41 to steering apparatus 50.

In the preferred embodiment illustrated, steering apparatus 50 is coupled through a pivotal bracket 51 to the side of tramming conveyor 10 while an output shaft 52 is likewise coupled to a pivotal bracket 53. In the embodiment illustrated in FIG. 1 only one steering control apparatus is illustrated. In the preferred embodiment a steering control apparatus is placed on each side of conveyor 10 to better control the movement of conveyor 10. Such dual cylinder arrangement is better illustrated in FIGS. 3, 4 and 5. It should be noted that bracket 51 is attached to segment 11*a* and bracket 53 is attached to discharge end 14 allowing two pivot points 13 to be located between the spacing of brackets 51 and 53. In the particular embodiment illustrated, each pivot point will provide an approximately 5° arcuate movement about pivot 13, thus, since the brackets are placed across two pivot locations, the total arcuate movement permitted is approximately 10°. If, of course, less than 10° is necessary, the brackets 51 and 53 can be placed across a single pivot point.

The tramming control system is illustrated in detail in FIG. 2. The enclosure for the tramming control system has been removed for clarity. That portion of the enclosure illustrated is a portion of bottom 55 and a portion of top 56. Shaft 42 is journaled in a bearing 57 which is attached through bolts 58 to bottom 55 and a bearing 59 which is likewise bolted (not shown) to top 56. A flange 60 is rigidly attached to shaft 42 and turns with the rotation of shaft 42. A second flange 61 is attached through bolts 62 which pass through arcuate slots 63. Arcuate slots 63 and bolt 62 permit rotation of flange 61 with respect to flange 60, thereby permitting an arcuate adjustment of following arm 44 so that the neutral position (to be described later) can be adjusted for proper operation of the tramming control system.

Brackets 64 provide a mounting for shaft 65 so that pivotal connection 43 can move upwardly or downwardly in direction of arrows 66, while movement in the direction of arrows 67 will cause rotation of shaft 42. A radial arm 70 is rigidly attached to shaft 42 at location 71 by any usual means such as welding. At the opposite end 72 is a notch 73 which passes around a switching shaft 74. Shaft 74 is journaled in a sliding bearing 75 which in turn is supported by a bracket 76 which is attached by means of bolts 77 to bottom 55. The other end 78 of shaft 74 is likewise journaled in a bearing (not shown) which is a part of hydraulic switch 79 which is not illustrated in detail but will be described in FIG. 6.

In order to provide a neutral location for arm 70, springs 80 are provided with a washer 81 on each side of spring 80 and an adjusting nut 82 threadably secured on shaft 74. A shaft travel limiting apparatus is provided which comprises locking nut 83 and washer 84 which is screwed against bearing 75. A similar locking nut 83*a* and washer 84*a* is screwed against the opposite end of bearing 75. Travel of shaft 74 in the direction of arrow 85 will permit bearing 75 to slide the distance illustrated by leaders 86. After traveling a distance agreed to, the distance illustrated by leaders 86, springs 80 will merely compress, thus protecting control valve confined in box 79.

An audible warning or other form of warning or protection for the control apparatus is provided by a relay or switch 90 operated by arms 91 which in turn are actuated by a relay control arm 92 attached at 93 radially to shaft 42. Relay arm 91 contains rollers 94 attached to upperwardly extending arms 95 which provide a means for rotating relay arm 91, thus, actuating relay or switch 90. Upon actuation of relay or switch 90 an output is generated through a wire 96 to an alarm or other protection circuit 97.

The operation of the device illustrated in FIG. 2 will first be described and then its cooperation and operation with the second conveyor or other apparatus will subsequently be described.

Referring in particular to FIG. 2, any movement of following arm 44 in the direction of arrow 67 will cause a corresponding rotation of shaft 42. Rotation of shaft 42 will cause a corresponding arcuate movement of radial arm 70 in the direction of arrow 100 or 101, depending upon the direction of rotation of shaft 42. If, for example, radial arm 70 moves in the direction of arrow 101, then end 72 of arm 70 will strike washer 81 causing spring 80 to slightly compress. Upon compression of spring 80, force will be exerted upon shaft 74, moving shaft 74 in the direction of arrow 101 causing the hydraulic relay contained in box 79 to actuate, creating an appropriate response in steering apparatus 50. Movement of radial arm 70 in the direction of 100 will likewise press washer 81 on the opposite side from that previously discussed, compressing spring 80 and causing shaft 74 to move in the same direction as arrow 100. Shaft 74 will then cause the hydraulic switch to operate correspondingly and move steering apparatus 50, correspondingly. Such movement will be further described in FIG. 6. It is obvious that if shaft 74 moves to the full extent illustrated by leaders 86, then washer 84*a* will strike bracket 76 causing the movement of shaft 74 to stop. Any additional movement of radial arm 70 in the direction of arrow 100 will merely compress spring 80, thus, protecting hydraulic section 79. If radial arm 70 continues to move in the direction of arrow 100, then radial arm 92 will likewise move in the direction of 100*a*. If shaft 42 should rotate past a predetermined number of degrees, then radial arm 92 will strike roller 94, causing arm 91 to actuate relay 90 developing an output in wire 96 to alarm or protection circuit 97. An alarm will sound then warning the operators to stop the operation of the steering apparatus or make corrections appropriate so that the steering apparatus will not be damaged. Rather than operating an alarm 97, it is obvious, that wire 96 could be coupled to a cut off system, thus, stopping any further correction of hydraulic switch confined in box 79. Movement of following arm 44 in the direction of arrow 66 will not cause rotation of arm 44 about axis 87, thus following arm 44 can accommodate changes in the placement in the tracks or changes in the level of the device to which it is connected without creating rotation in arms 70 or 92, energizing the hydraulic circuit or the alarm circuit, respectively.

Figure 3:
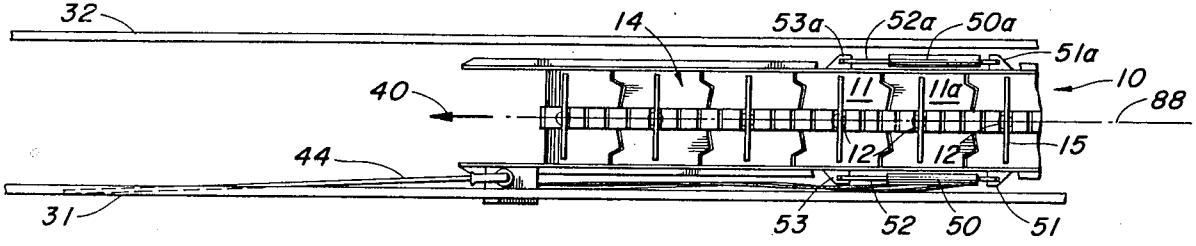
FIG. 3 is a top view of the apparatus illustrated in FIG. 1 with the control arm in a neutral position.
Figure 4:
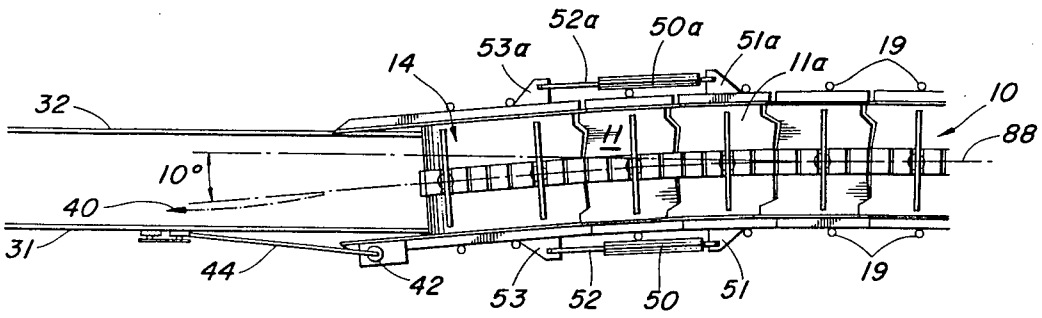
FIG. 4 is a top view of the apparatus illustrated in FIG. 2 with the control arm moved to the right.
Figure 5:
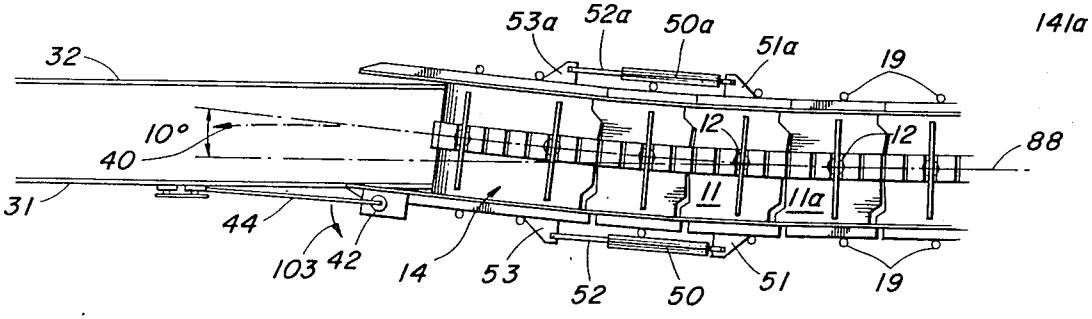
FIG. 5 is a top view of the apparatus illustrated in FIG. 2 with the control arm moved to the left.

Referring to FIGS. 3, 4 and 5, the actual operation of the steering control system can best be illustrated. Referring in particular to FIG. 3, conveyor 10 is illustrated in a proper or correct position. That is, conveyor 10 is located centrally between tracks 31 and 32. No correction is needed for steering control apparatus 50 and thus, following arm 44 is in a neutral location generating no signal to steering apparatus 50. In the embodiment illustrated in FIG. 3, the steering apparatus on the opposite side will contain numbers with the subscript "a". Steering apparatus on the right side of conveyor apparatus 10, when moving in the direction of 40, will have both output shafts 52 and 52*a* the same length, causing segments 11*a*, 11 and discharge end 14 to be substantially aligned with axis 88 of tramming conveyor 10.

Referring to FIG. 4, however, tramming conveyor 10 is substantially to one side of rails 31 and 32. As illustrated in FIG. 4, axis 88 of tramming conveyor 10 is on the side of rail 32, rather than being centered between rails 31 and 32. Arm 44 has been deflected in a manner to move discharge end 14 along arrow 40 to a location where it is now substantially in alignment with rails 31 and 32. Under these conditions then, arm 44 will indicate that tramming conveyor 44 should begin to straighten up so that its axis will eventually be aligned between rails 31 and 32. Such rotation of arm 44 will cause an output in steering apparatus 50 to extend shaft 52, thus, straightening segments 11 and 11*a* with respect to discharge end 44. Likewise, shaft 52*a* of steering cylinder 52*a* will retract cooperating with steering apparatus 50, causing segments 11 and 11*a* to be substantially in alignment with discharge end 14.

In FIG. 5, tramming conveyor 10 has been on the side of rail 31 with shaft 52 extend and shaft 52*a* retracted in order to bring tramming conveyor 10 back into alignment so that axis 88 is substantially aligned between rails 31 and 32. When discharge end 14 is substantially aligned with rails 31 and 32 and begins to over shoot the rails, arm 44 will move in the direction of arrow 103 causing output shaft 52 to retract and shaft 52*a* to extend straightening segments 11 and 11*a* with respect to discharge end 14. It is obvious that FIGS. 4 and 5 are exaggerated under normal conditions and that the tramming conveyor would not get so far out of alignment as illustrated in FIGS. 4 and 5. Generally, any slight misalignment of discharge end 14 will cause immediate response by way of following arm 44 through shaft 42, operating the system as described with FIG. 2, creating an immediate correction signal causing tramming conveyor 10 to realign itself between rails 31 and 32.

Figure 6:
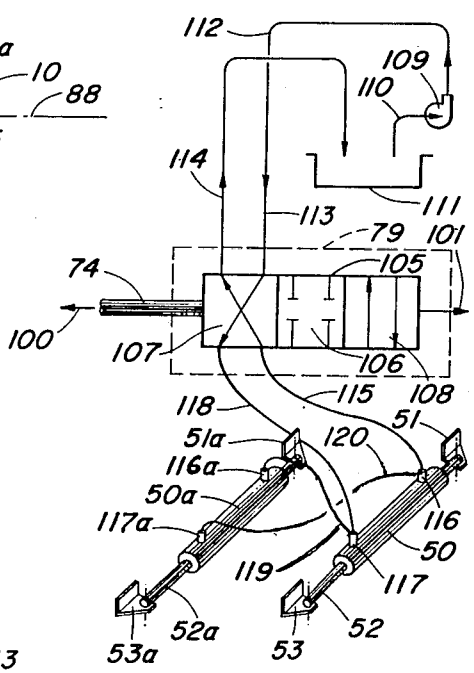
FIG. 6 is a detailed of the hydraulic control system.

Device illustrated in FIGS. 1 through 5 hydraulically functions as illustrated in FIG. 6. In this drawing valve box 79 contains a hydraulic valve 105, contains a neutral section 106, a first position 107 and a second position 108. A hydraulic pump 109 is coupled through a pipe 110 to a sump 111. The output of hydraulic pump 109 is coupled through a pipe or hose 112 to input side 113 of valve 105. The return of valve 105 is coupled through a pipe or hose 114 to sump 111. One output of valve 105 is coupled through a pipe or hose 115 to one port 116 of steering apparatus 50. A second port 117, which can function as an inlet or outlet port to steering apparatus 50 which is here illustrated as a cylinder, is coupled through a pipe 118 to the other outlet port from valve 105. Valve 105 is a standard valve having a reversing feature in the first position 107, a straight through position in the second position or 108 and a return position in the neutral or 106 position. Pipes 119 and 120 are coupled to opposite ports 117*a* and 116*a* of steering control apparatus or cylinder 50*a*.

The operation of FIG. 6 is as follows, with shaft 74 in the neutral position, pipes 112, 113 and 114 are connected to the closed center neutral section 106 of valve 105, thus, no fluid circulates. If shaft 74 should shift in the direction of arrow 101, for example, then pipe 113 would be coupled to pipe 118 and to ports 117 and 116*a* of cylinders of 50 and 50*a*, respectively, while pipe 114 is connected through pipe 115 to ports 116 and 117*a*, respectively. Under these conditions, cylinder 50 would be pressured at port 117 causing shaft 52 to retract, while cylinder 50*a* would have port 116*a* pressured causing shaft 52*a* to extend. Then remaining ports would be coupled to sump 111. If shaft 74 should move from neutral in the direction of arrow 100, then pipes 113 and 114 would be coupled straight through as illustrated in position 108 or the second position of valve 105. Under these conditions, the reverse ports would be pressured causing port 116 to be pressured and port 117*a* to be pressured and the opposite ports to be turned to sump 111, thus, shaft 52 would retract and shaft 52*a* would extend causing the apparatus to steer in the opposite direction.

Basically the apparatus illustrated in FIGS. 2 through 6 will cause the discharge end of the conveyor to tram in the direction of the movement of the arm, therefore, if arm 44 moves to the left, discharge end 14 will move to the left, while if arm 44 is rotated to the right, then discharge end 14 will tram toward the right, by corresponding extensions and contractions of output shafts 52 and 52*a*, respectively.

Figure 7:
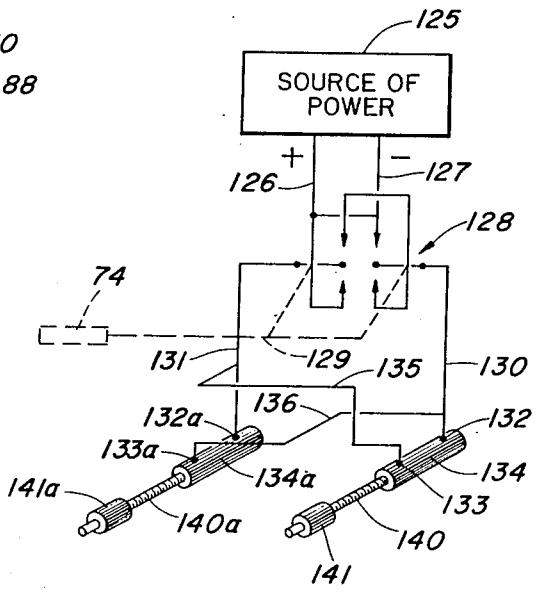
FIG. 7 is a corresponding electrical circuit which is substantially identical to that shown in FIG. 6.

Referring to FIG. 7, it is obvious that an alternate method may be used to control the steering of discharge end 14, for example, of tramming conveyor 10. Such alternate source could be electricity. In the embodiment illustrated in FIG. 7, a source of power 125 has a positive lead 126 and a negative lead 127 connected to a reversing switch 128. Reversing switch 128 is connected in the usual manner with its arm connected through a mechanical linkage 129 to shaft 74 (not illustrated). The output from reversing switch 128 is carried through wires 130 and 131 to motor input terminals 132 and 133 of motor 134 and while wire 131 is coupled to input terminals 132*a* and 133*a* of motor 134*a*. A cross lead 135 is coupled to terminal 133, while cross lead 136 is connecting to corresponding terminal 133*a*. Motors 134 and 134*a* have an output screw shaft 140 and 140*a*, respectively, connected to a threaded mounting bracket 141 and 141*a*, respectively. Brackets 141 and 141*a* would be coupled to brackets 53 and 53*a*, respectively (not illustrated) while motors 134 and 134*a* would likewise be connected to brackets 51 and 51*a* (not illustrated). The device of FIG. 7 would operate precisely in accordance with the description of FIG. 6 with the exception that electrical circuits are involved rather than hydraulic. Thus, when switch 128 is in the neutral position, as illustrated, no power is applied to either motor, thus, neither motor is operating. When shaft 74 through mechanical linkage 129 moves the contacts to a first position, then power will be applied to rotate motor 134 in one direction and motor 134*a* in the opposite direction causing rotation of screw shafts 140 and 140*a* in a manner to cause the distance between the mounting brackets to extend on one motor and to reduce on the other motor. When shaft 74 causes a corresponding movement of switch 128 to the opposite set of connection, the reverse will occur.

CONCLUSIONS

An automatic steering apparatus for a tramming conveyor has been illustrated which permits a tramming conveyor to tram in a direction and cause the tramming conveyor to at all times remain properly aligned with an external apparatus, such as an overhead mine rail or a following conveyor. The embodiment has illustrated the following arm or arm to be connected to an overhead rail, it is obvious that the following arm can be connected to any apparatus such as the following conveyor or be controlled by a person and still be well within the scope of this invention. It is further obvious, that while the hydraulic system has been specifically described in the embodiment illustrated, that an electrical system is correspondingly operable and furthermore, any fluid system can be utilized, such as compressed air and vacuum.

It is obvious, of course, that other modifications can be used and still be well within the spirit and scope of this invention as described in the specification and appended claims.

What I claim is:

1. In a tramming conveyor having a plurality of sections pivotally interconnected on a vertical axis, said conveyor having a top, bottom, sides and a longitudinal axis, a material receiving end and a discharge end, and belt means extending the length of said tramming conveyor having a portion both on top of and on the bottom of said conveyor, said bottom portion selectively contactable with the surface of the earth in a manner to propel said conveyor in a selected longitudinal direction, an apparatus for steering a selected end of said conveyor in a manner to track an external apparatus comprising:

(a) control means mounted on said conveyor at said end to be steered, said control means including switch means and means coupled to said external apparatus and responsive to the location of said external apparatus for operating said switch means in a manner to generate an output;

(b) steering means attached to said conveyor across at least one of said pivoted sections at said end to be steered;

(c) means coupling the output from said switch means to said steering means;

whereby operation of said switch means will cause said switch means output to control said steering means in a manner to deflect said selected end angularly away from said longitudinal axis in a manner to track said external apparatus, said control means comprises a shaft having a radial arm means extending therefrom and activation means positioned on each side of said radial arm means in a manner to generate a first output when said radial arm moves arcuately from a neutral position in a first direction in response to a rotation of said shaft and a second output when said radial arm moves from said neutral position in a direction opposite from said first direction, said neutral position generating neither said first or second output; second radial arm means is attached to said shaft switch means; circuit means; means coupled to said second radial arm means for activating said switch means when said second radial arm means rotates a predescribed number of degrees, said switch means coupled to said circuit means in a manner to operate said circuit means when said second radial arm means has rotated through said selected number of degrees.

2. In a tramming conveyor having a plurality of sections pivotally interconnected on a vertical axis, said conveyor having a top, bottom, sides and a longitudinal axis, a material receiving end and a discharge end, and belt means extending the length of said tramming conveyor having a portion both on top of and on the bottom of said conveyor, said bottom portion selectively contactable with the surface of the earth in a manner to propel said conveyor in a selected longitudinal direction, an apparatus for steering a selected end of said conveyor in a manner to track an external apparatus comprising:

(a) control means mounted on said conveyor at said end to be steered, said control means including switch means and means coupled to said external apparatus and responsive to the location of said external apparatus for operating said switch means in a manner to generate an output;

(b) steering means attached to said conveyor across at least one of said pivoted sections at said end to be steered;

(c) means coupling the output from said switch means to said steering means;

whereby operation of said switch means will cause said switch means output to control said steering means in a manner to deflect said selected end angularly away from said longitudinal axis in a manner to track said external apparatus; said control means comprises a shaft having a radial arm means extending therefrom and activation means positioned on each side of said radial arm means in a manner to generate a first output when said radial arm moves arcuately from a neutral position in a first direction in response to a rotation of said shaft and a second output when said radial arm moves from said neutral position in a direction opposite from said first direction, said neutral position generating neither said first or second output, said means coupled to said external apparatus and responsive to the location of said external apparatus for operating said switch means comprises an extended lever arm vertically pivotally attached to said vertical shaft on one end and pivotally attached to its external apparatus on said other end; second radial arm means is attached to said shaft switch means; alarm means; means coupled to said second radial arm means for activating said switch means when said second radial arm means rotates a predescribed number of degrees, said switch means coupled to said alarm means in a manner to operate said alarm means indicating that said second radial arm means has rotated through said selected number of degrees whereby an operator can be warned of the excessive rotation of said shaft means and respond thereto.

3. In a tramming conveyor having a plurality of sections pivotally interconnected on a vertical axis, said conveyor having a top, bottom, sides and a longitudinal axis, a material receiving end and a discharge end, and belt means extending the length of said tramming conveyor having a portion both on top of and on the bottom of said conveyor, said bottom portion selectively contactable with the surface of the earth in a manner to propel said conveyor in a selected longitudinal direction, an apparatus for steering a selected end of said conveyor in a manner to track an external apparatus comprising:

(a) control means mounted on said conveyor at said end to be steered, said control means including switch means and means coupled to said external apparatus and responsive to the location of said external apparatus for operating said switch means in a manner to generate an output;

(b) steering means attached to said conveyor across at least one of said pivoted sections at said end to be steered;

(c) means coupling the output from said switch means to said steering means;

whereby operation of said switch means will cause said switch means output to control said steering means in a manner to deflect said selected end angularly away from said longitudinal axis in a manner to track said external apparatus; said control means comprising a shaft having a radial arm means extending therefrom and activation means positioned on each side of said radial arm means in a manner to generate a first output when said radial arm moves arcuately from a neutral position in a first direction in response to a rotation of said shaft and a second output when said radial arm moves from said neutral position in a direction opposite from said first direction, said neutral position generating neither said first or second output; said activation means comprises a shaft means positioned transverse to the longitudinal axis of said radial arm means; said shaft means having one end journaled in a bearing means and a second end coupled to said switch means; first and second spring means mounted on said shaft means on each side of said radial arm means; said spring means positioned away from said radial arm means in a manner to provide a neutral space so that said radial arm means can move a predescribed number of degrees without striking either said first or said second spring means and when said radial arm means strikes said first or second spring means, said spring means will urge said shaft in a direction responsive to the movement of said radial arm means, thereby activating said switch means in said first or second output positions.

4. Apparatus as described in claim 3 additionally including an over travel warning system comprising switch means mounted on each side of said radial arm means; said switch means being activated by a predetermined number of degrees of rotation by said radial arm means; alarm means; and means for coupling said alarm means to said switch means in a manner to sound said alarm means upon activation of said switch means.

5. Apparatus for steering a tramming conveyor so that said tramming conveyor will track an external apparatus said tramming conveyor having a material input end, a material discharge end with a longitudinal axis; said tramming conveyor having one of said ends articulated; said steering apparatus comprising:

(a) a control means mounted on said conveyor; said control means including a switch means and means coupled between said control means and said external apparatus and responsive to the location of said external apparatus for operating said switch means in a manner to generate an output;

(b) a steering means attached to said conveyor between said conveyor and said articulated end;

(c) a means coupling said output from said switch means to said steering means whereby operation of said switch means will cause said switch means output to control said steering means in a manner to deflect said articulated end angularly away from said longitudinal axis in a manner to track said external apparatus;

said control means includes a shaft, and means for journaling said shaft for rotation of said shaft about its axis, radial arm means attached to the periphery of said shaft and extending from said shaft; means for coupling said radial arm means to said switch means in a manner to provide a neutral position, a first position and a second position and wherein said first position provides a first output to said steering means which causes a movement of said articulated end angularly from said longitudinal axis in a first direction and said second position operates said switch means to generate an output causing said steering means to deviate said articulated end about said longitudinal axis in the opposite direction from said first position and said neutral position causes no deviation of said switch in either said first or second position; second radial arm means is attached to said shaft switch means; alarm means and second switch means; means coupled to said second radial arm means for activating said second switch means when said second radial arm means rotates a predescribed number of degrees, said second switch means coupled to said alarm means in a manner to operate said alarm means indicating that said second radial arm means has rotated through said predescribed number of degrees whereby an operator can be warned of the excessive rotation of said shaft means and respond thereto.

* * * * *